US007913700B2

(12) United States Patent
Calandro et al.

(10) Patent No.: US 7,913,700 B2
(45) Date of Patent: Mar. 29, 2011

(54) NONTOBACCO MOIST SNUFF COMPOSITION

(75) Inventors: Daniel Calandro, Sandy Hook, CT (US); Joseph Ackilli, South Salem, NY (US); Harry Topalian, Weston, CT (US)

(73) Assignee: Smokey Mountain Chew, Inc., Sandy Hook, CT (US)

( * ) Notice: Subject to any disclaimer, the term of this patent is extended or adjusted under 35 U.S.C. 154(b) by 79 days.

(21) Appl. No.: 10/334,327

(22) Filed: Dec. 31, 2002

(65) Prior Publication Data

US 2004/0123873 A1 Jul. 1, 2004

(51) Int. Cl.
*A24B 15/00* (2006.01)

(52) U.S. Cl. ..... 131/359; 131/352

(58) Field of Classification Search ..... 131/359, 131/352, 360, 364
See application file for complete search history.

(56) References Cited

U.S. PATENT DOCUMENTS 2,943,958 A * 7/1960 Schaflander ..... 131/359
2,943,959 A * 7/1960 Schaflander ..... 131/359
3,067,068 A * 12/1962 Finberg ..... 131/359
3,559,655 A 2/1971 Briskin et al.
3,782,392 A 1/1974 Monte
3,875,948 A 4/1975 Monte
3,968,804 A 7/1976 Kelly et al.
4,414,199 A * 11/1983 Strobridge ..... 424/52
4,696,315 A * 9/1987 Summers ..... 131/359
4,813,438 A 3/1989 Fleming
4,817,640 A * 4/1989 Summers ..... 131/359
4,887,620 A 12/1989 Summers
4,969,477 A 11/1990 Yagisawa
5,417,229 A * 5/1995 Summers et al. ..... 131/359
5,972,322 A * 10/1999 Rath et al. ..... 424/70.11

FOREIGN PATENT DOCUMENTS

CN 1159305 A * 9/1997

* cited by examiner

*Primary Examiner* — Richard Crispino
*Assistant Examiner* — Michael J Felton
(74) *Attorney, Agent, or Firm* — Scott T. Griggs; Griggs Bergen LLP

(57) ABSTRACT

The present invention provides a nontobacco or herbal moist snuff composition comprising an herbal component comprising, or consisting essentially of, corn silk. The present invention also provides a method of producing a nontobacco moist snuff composition having an herbal component comprising, or consisting essentially of, corn silk. Corn silk has a light texture, smooth mouth feel, uniform appearance, and a smell and taste that is nonexistent or easily disguisable. When corn silk is combined with a suitable casing component, the resulting nontobacco moist snuff composition has a light, elastic, and moist texture, a soft and smooth mouth feel, a uniform color and particle size, and a long lasting and tobacco-like smell and taste with a characteristic tobacco-like "bite."

11 Claims, 4 Drawing Sheets

| INGREDIENT | CLASSIC | WINTERGREEN | MINT | CHERRY |
|---|---|---|---|---|
| Cayenne powder | 0.50 | 0.10 | 0.10 | 0.10 |
| Ginseng | 1.00 | 1.00 | 1.00 | 1.00 |
| Guarana | 0.50 | 0.40 | 0.40 | 0.40 |
| Corn silk | 25.00 | 25.00 | 24.00 | 24.30 |
| Sodium bicarbonate | 2.50 | 1.00 | 1.00 | 1.00 |
| Sodium chloride | 4.50 | 5.00 | 5.00 | 5.00 |
| Classic flavor | 3.00 | | | |
| Peppermint flavor | | | 8.00 | |
| Cinnamon flavor | | | | |
| Wild cherry flavor | | | | 6.00 |
| Wintergreen flavor | | 5.00 | | |
| Molasses | 28.00 | 30.00 | 30.00 | 28.00 |
| Caramel color | 6.00 | 5.50 | 5.50 | 6.00 |
| Glycerine/propylene glycol/preservatives | 15.00 | 15.00 | 15.00 | 16.00 |
| Water | 14.00 | 12.00 | 10.00 | 12.00 |
| Artificial sweetener | | | | 0.20 |
| Nicotine | | | | |

| INGREDIENT | CLASSIC | WINTERGREEN | MINT | CHERRY |
|---|---|---|---|---|
| Cayenne powder | 0.50 | 0.10 | 0.10 | 0.10 |
| Ginseng | 1.00 | 1.00 | 1.00 | 1.00 |
| Guarana | 0.50 | 0.40 | 0.40 | 0.40 |
| Corn silk | 25.00 | 25.00 | 24.00 | 24.30 |
| Sodium bicarbonate | 2.50 | 1.00 | 1.00 | 1.00 |
| Sodium chloride | 4.50 | 5.00 | 5.00 | 5.00 |
| Classic flavor | 3.00 | | | |
| Peppermint flavor | | | 8.00 | |
| Cinnamon flavor | | | | |
| Wild cherry flavor | | | | 6.00 |
| Wintergreen flavor | | 5.00 | | |
| Molasses | 28.00 | 30.00 | 30.00 | 28.00 |
| Caramel color | 6.00 | 5.50 | 5.50 | 6.00 |
| Glycerine/propylene glycol/preservatives | 15.00 | 15.00 | 15.00 | 16.00 |
| Water | 14.00 | 12.00 | 10.00 | 12.00 |
| Artificial sweetener | | | | 0.20 |
| Nicotine | | | | |

FIG. 1

| INGREDIENT | CINNAMON | NICOTINE | RANGE |
|---|---|---|---|
| Cayenne powder | 0.20 | 0.30 | 0.01 - 0.50 |
| Ginseng | 1.00 | | 1.00 - 2.00 |
| Guarana | 0.50 | | 0.20 - 1.00 |
| Corn silk | 24.50 | 25.00 | 16.00 - 32.00 |
| Sodium bicarbonate | 2.50 | 2.50 | 1.00 - 3.00 |
| Sodium chloride | 5.00 | 4.50 | 3.00 - 5.00 |
| Classic flavor | | 3.00 | 2.00 - 5.00 |
| Peppermint flavor | | | 5.00 - 10.00 |
| Cinnamon flavor | 3.50 | | 2.00 - 5.00 |
| Wild cherry flavor | | | 5.00 - 10.00 |
| Wintergreen flavor | | | 3.00 - 6.00 |
| Molasses | 29.00 | 29.00 | 18.00 - 38.00 |
| Caramel color | 6.00 | 5.50 | 3.50 - 8.10 |
| Glycerine/propylene glycol/preservatives | 15.00 | 15.00 | 9.00 - 21.00 |
| Water | 12.80 | 15.00 | 8.00 - 18.00 |
| Artificial sweetener | | | 0.15 - 0.35 |
| Nicotine | | 0.20 | 0.01 - 0.20 |

FIG. 1A

NONTOBACCO MOIST SNUFF COMPOSITION

This application claims priority from application Ser. No. 10/334,327 filed on Dec. 31, 2002.

BACKGROUND OF THE INVENTION

1. Field of the Invention

This invention relates to tobacco substitute products. More specifically, this invention relates to products that comprise a tobacco substitute and are intended for personal use for smoking, chewing, or for use as snuff. In particular, this invention relates to nontobacco compositions that are intended for personal use as moist snuff.

2. Description of the Prior Art

Tobacco can be used and/or consumed in a variety of products and methods. Most commonly, tobacco is smoked, chewed, or used as snuff.

Smokeless tobacco products are tobacco-based products that are held in the mouth for an extended period of time and either chewed or used as snuff ("dipped"). Chewing tobacco, which is popularly called chew or chaw, is available as coherent plugs. On the other hand, snuff is not chewed. Snuff is available in two forms—dry for sniffing, and moist (or wet) for holding between the lips and gums. The practice of using moist snuff is popularly called dipping.

Unfortunately, the nicotine in tobacco is a substance to which people may become addicted. In addition, diseases, such as cancer of the mouth, may be caused by chewing or holding tobacco in the mouth. Thus, increasing attention by the medical profession and the public has been directed against chewing tobacco and moist snuff.

In light of the foregoing, there is a need for nontobacco products intended for personal use as chew or snuff. Such smokeless nontobacco products may be offered as a more healthy alternative to smokeless tobacco products, especially for those who currently use smokeless tobacco products. Smokeless nontobacco products could be developed without addictive nicotine.

As used herein, whether in reference to tobacco products or nontobacco products, the terms "wet snuff" and "moist snuff" refer to smokeless products that are held in the mouth between the lips and gums, and that are not chewed. Moist snuff is distinct from smokeless tobacco products that are chewed or inhaled because smokeless tobacco products that are chewed will have organoleptic qualities that are clearly distinguishable from the organoleptic qualities of moist snuff. For example, chewing tobacco will have an herbal component with ingredients of larger size compared to moist snuff so that portions of the chewing tobacco are not inadvertently swallowed while being chewed. Moreover, chewing tobacco will have specifically selected ingredients that result in the chewing tobacco forming a highly coherent cud in the mouth compared to snuff, again, so that that portions of the chewing tobacco are not inadvertently swallowed while being chewed. On the other hand, since moist snuff is held between the lips and gums, instead of being chewed, a moist snuff composition will be produced with fine or pulverized ingredients instead of large sized ingredients. A moist snuff composition will also have ingredients that form a softer, more flexible cud.

For a moist snuff composition, whether tobacco-based or nontobacco, the key organoleptic characteristics are texture, mouth feel or body, appearance, smell, and taste. For many reasons, it is necessary that nontobacco moist snuff compositions, which are intended as alternatives to tobacco-based moist snuff compositions, possess organoleptic qualities that are similar to the organoleptic qualities of tobacco-based moist snuff compositions. In particular, any alternative nontobacco moist snuff composition must match as nearly as possible the light texture, smooth mouth feel, uniform appearance, inviting smell, and spicy taste of a comparative tobacco-based moist snuff composition. One reason that nontobacco moist snuff compositions should match the organoleptic qualities of tobacco-based moist snuff compositions is to encourage use thereof by current users of tobacco-based moist snuff, since current tobacco-based moist snuff users are likely to be the primary users for nontobacco moist snuff compositions. However, the organoleptic qualities of tobacco-based moist snuff compositions, are difficult to produce in a nontobacco moist snuff compositions.

Moist snuff is produced from two components—an herbal component and a casing component. The herbal component is a mixture of cut, shredded, and/or pulverized plants (e.g., tobacco leaves). The herbal component mixture is developed to optimize the key organoleptic characteristics of the moist snuff, namely texture, mouth feel or body, appearance, smell, and taste. The herbal component is made moist by the addition of the casing component, which, along with water, principally comprises several selected flavoring agents, as well as preservatives to maintain flavor and inhibit spoilage. The casing component also enhances the overall organoleptic qualities of the moist snuff and, in particular, enhances texture, appearance, smell, and taste. In fact, the casing component will have a measurable effect on the overall texture, appearance, smell, and taste of the moist snuff. Nonetheless, the casing component cannot overcome many undesirable organoleptic qualities that may be present in the herbal component. For example, the casing component cannot obscure the presence of seeds and jagged stalks, which adversely effect texture, mouth feel, and appearance. Furthermore, the casing component cannot completely cover bitter, inappropriate, or otherwise objectionable smells and tastes, which may be present especially, for example, if the herbal component contained mint, dandelion, alfalfa, or chicorium leaves. Thus, to obtain superior overall organoleptic qualities in a moist snuff composition, it is critical that the herbal component thereof have superior organoleptic qualities.

Nontobacco or "herbal" compositions intended for personal use as moist snuff have been developed and described in U.S. Pat. No. 4,696,315 ("the '315 patent") and U.S. Pat. No. 4,817,640 ("the '640 patent") that both issued to Summers. In addition, the importance of matching the organoleptic qualities of nontobacco moist snuff compositions to the organoleptic qualities of tobacco-based compositions is recognized by several published U.S. patents, including the '640 patent and two other U.S. patents that issued to Summers, U.S. Pat. No. 4,887,620 ("the '620 patent"), and U.S. Pat. No. 5,417,229 ("the '229 patent").

As opposed to the herbal chewing compositions described in the '315 and '640 patents, the herbal moist snuff compositions described in the '315 and '640 patents include red clover as the major ingredient in the herbal component thereof. Specifically, as described in Example II of the '640 patent, red clover is, in fact, the only ingredient of the herbal component. It is noteworthy that red clover blossom is considered so essential for an herbal moist snuff composition that the exemplary herbal snuff compositions of the '315 and '640 patents do not contain any other herbal ingredient besides red clover blossoms. However, as discussed in more detail below, nontobacco moist snuff compositions that consist of red clover fail to achieve desirable tobacco-like organoleptic qualities, which is the most important requirement for an effective and commercially successful nontobacco moist snuff composition.

Besides red clover, many other potential ingredients for the herbal component of the herbal moist snuff are briefly mentioned in the '640 and '229 patents, such as dandelion, papaya, dock, sorrel, sunflower, calendula, nasturtium, mallow, chicory, corn silk. However, especially since corn silk has been heretofore almost exclusively recognized in the prior art as a medicinal herb, the '640 and '229 do not appreciate that the beneficial physical characteristics other herbs besides red clover can achieve superior organoleptic qualities in a nontobacco moist snuff composition. Accordingly, nontobacco moist snuff compositions with alternative ingredients, other than red clover, are not described in the '640 and '229 patents with any amount of detail. In fact, as stated above, the disclosures of the '640 and '229 patents regarding moist snuff compositions are directed to the use of red clover exclusive of any other potential ingredient.

Nontobacco moist snuff compositions that consist of red clover blossom fail to imitate the organoleptic qualities of tobacco-based moist snuff compositions. First, red clover blossom must be picked by hand. Any seed and stalks attached to the picked red clover blossom must be carefully separated. Yet, especially due to the small size of the blossoms, stalks, and seeds, it is inevitable that the mixture of pulverized red clover blossom will include an amount of stalks and seeds. The lack of a uniform mixture of red clover has several adverse effects, especially to texture, mouth feel, and appearance. Specifically, the stalks and seeds are harder, drier, sharper, and lighter in color compared to the pulverized blossoms. Also, the stalks and seeds do not adequately absorb the coloring ingredients in the casing component, which further accentuates the non-uniform appearance of the mixture. Furthermore, regardless of the uniformity of the mixture, red clover presents its own vegetal flavor, which will undesirably and inappropriately taint an herbal moist snuff composition attempting to imitate a tobacco-based moist snuff composition.

In light of the foregoing, there is an ongoing need for a new nontobacco ingredient suitable for use as an ingredient in the herbal component of an herbal moist snuff composition. Unlike red clover, the new ingredient would provide the herbal moist snuff composition with superior organoleptic qualities that are favorably comparable to the organoleptic qualities of tobacco-based moist snuff compositions. Specifically, there is a need for a new nontobacco ingredient that has a light texture, smooth mouth feel, uniform appearance, and a smell and taste that is nonexistent or easily disguisable. When such a new nontobacco ingredient is combined with a suitable casing component, the resulting nontobacco moist snuff composition has a light, elastic, and moist texture, a soft and smooth mouth feel, a uniform color and particle size, and a long lasting and tobacco-like smell and taste with a characteristic tobacco-like "bite."

SUMMARY OF THE INVENTION

It is an object of the present invention to provide a new nontobacco ingredient suitable for use as the major ingredient in the herbal component of an nontobacco moist snuff composition.

It is an object of the present invention to provide such a new nontobacco ingredient that will provide an nontobacco moist snuff composition with superior organoleptic qualities that are favorably comparable to the organoleptic qualities of tobacco-based moist snuff compositions.

It is also an object of the present invention to provide a method of producing a moist snuff composition having a nontobacco herbal component that provides the nontobacco moist snuff composition with superior organoleptic qualities that are favorably comparable to the organoleptic qualities of tobacco-based moist snuff compositions.

In light of the foregoing background and objects, the present invention provides a nontobacco moist snuff composition comprising an herbal component comprising, or consisting essentially of, corn silk. The present invention also provides a method of producing a nontobacco moist snuff composition having an herbal component comprising, or consisting essentially of, corn silk. Corn silk has a light texture, smooth mouth feel, uniform appearance, and a smell and taste that is nonexistent or easily disguisable. When corn silk is combined with a suitable casing component, the resulting nontobacco moist snuff composition has a light, elastic, and moist texture, a soft and smooth mouth feel, a uniform color and particle size, and a long lasting and tobacco-like smell and taste with a characteristic tobacco-like "bite."

BRIEF DESCRIPTION OF THE FIGURES

The above-mentioned objects and features of the present invention, as well as additional objects and features, can be understood from the description of the invention presented herein below, taken in combination with the accompanying drawings, in which:

FIG. 1 is a first table of ingredients for several embodiments of a nontobacco moist snuff composition according to the present invention;

FIG. 1A is a second table of ingredients for several embodiments of a nontobacco moist snuff composition according to the present invention;

DETAILED DESCRIPTION OF THE INVENTION

Figure 2:
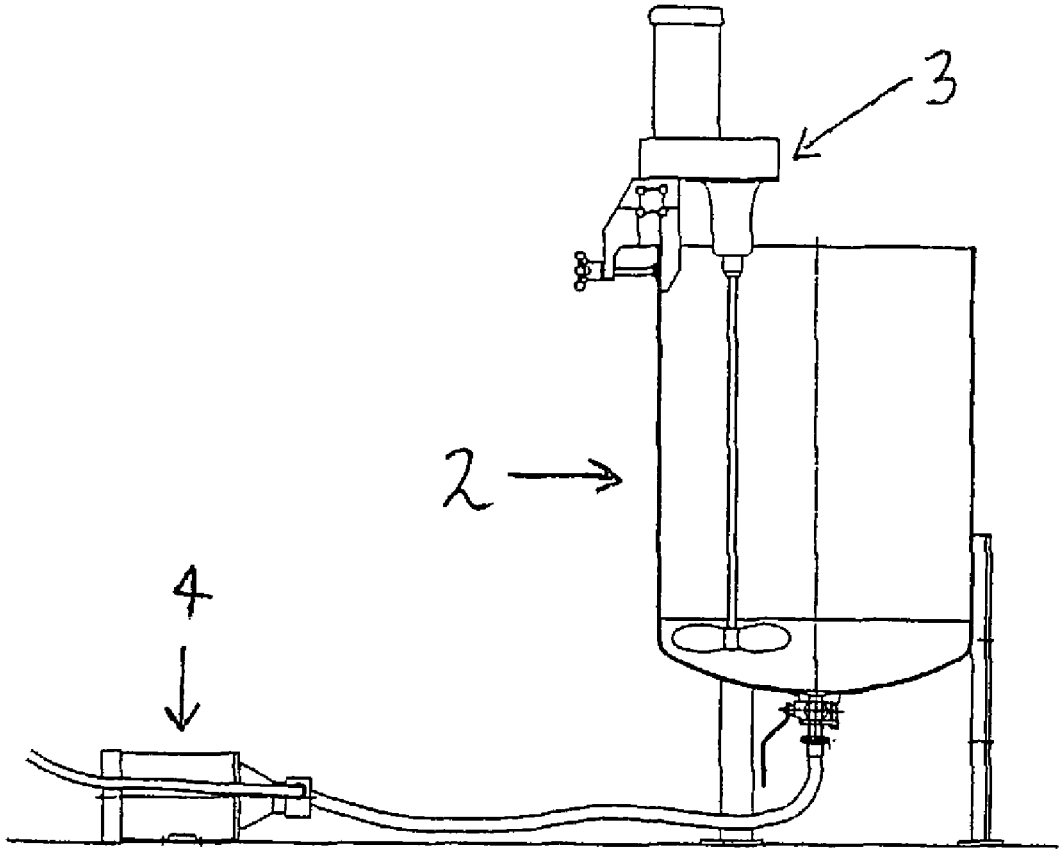
FIG. 2 is a side view of a kettle mixer useful for making the casing component for a nontobacco moist snuff composition according to the present invention.

The present invention provides a nontobacco moist snuff compositions and methods of producing such nontobacco moist snuff compositions. In particular, the herbal component of the nontobacco moist snuff composition consists essentially of corn silk. It has been surprisingly discovered that a nontobacco moist snuff compositions, with an herbal component consisting essentially of corn silk, possess superior organoleptic qualities that are favorably comparable to the organoleptic qualities of tobacco-based moist snuff compositions.

An important aspect of the present invention is providing nontobacco moist snuff compositions with the texture, mouth feel, appearance, smell, and taste of comparative tobacco-based moist snuff compositions. For example, since compositions according to the present invention are intended to remain in the mouth for an extended period of time, it is essential to find a combination of components and ingredients thereof that present a characteristic spicy taste or "bite" evenly throughout the composition so as not to cause uncomfortable hot spots in the mouth. Compositions according to the present invention provide a sustained organoleptic qualities.

It is contemplated that a nontobacco moist snuff composition according to the present invention comprising an herbal component and a casing component, as described in further detail hereinafter, may be prepared in accordance with Table 1, Table 2, and Table 3:

TABLE 1

| Components - Approx. % by Weight of the Total Composition | |
|---|---|
| Component | % |
| Herbal | 10 to 50 |
| Casing | 50 to 90 |

TABLE 2

| Components - Preferred % by Weight of the Total Composition | |
|---|---|
| Component | % |
| Herbal | 15 to 35 |
| Casing | 65 to 85 |

TABLE 3

| Components - More Preferred % by Weight of the Total Composition | |
|---|---|
| Component | % |
| Herbal | 16 to 32 |
| Casing | 68 to 84 |

The following Table 4 shows preferred ingredients for nontobacco moist snuff compositions according to the present invention. The ingredients listed in Table 5 are discussed in more detail herein below.

TABLE 4

| Ingredients - Approx. Ranges in % by Weight of the Total Composition | | |
|---|---|---|
| INGREDIENT | APPROX. LOWEST | APPROX. HIGHEST |
| Artificial sweetener | 0.15 | 0.35 |
| Caramel color | 3.50 | 8.10 |
| Cayenne powder | 0.01 | 0.50 |
| Corn silk | 16.00 | 32.00 |
| Flavorings - Cinnamon* | 2.00 | 5.00 |
| Flavorings - Classic* | 2.00 | 5.00 |
| Flavorings - Peppermint* | 5.00 | 10.00 |
| Flavorings - Wild cherry* | 5.00 | 10.00 |
| Flavorings - Wintergreen* | 3.00 | 6.00 |
| Ginseng | 1.00 | 2.00 |
| Glycerin/propylene glycol/preservatives | 9.00 | 21.00 |
| Guarana (caffeine) | 0.20 | 1.00 |
| Molasses | 18.00 | 38.00 |
| Nicotine** | 0.01 | 0.20 |
| Sodium bicarbonate | 1.00 | 3.00 |
| Sodium chloride | 3.00 | 5.00 |
| Water | 8.00 | 18.00 |

*Preferably, only one flavoring ingredient is used per composition
**Optional ingredient 1. The Herbal Component Corn silk (*Stigmata maidis*) is the essential ingredient of the herbal component or base component in the nontobacco moist snuff compositions of the present invention. The prolongated styles on ears of corn (*Zea Mays*) are referred to as corn silk. Corn silk has been smoked as a very inexpensive alternative to smoking tobacco. In addition, corn silk has been used for many centuries as a medicinal herb, in particular, as a stimulant, diuretic, and/or demulcent. However, the present invention is not a composition for smoking, and corn silk is not used in the present invention for its medicinal qualities. It has been surprisingly discovered that corn silk may be used as the essential ingredient of the herbal component in nontobacco moist snuff compositions to provide superior organoleptic qualities that are favorably comparable to tobacco-based moist snuff compositions.

When corn silk is included in the herbal component at any amount from 0% to 100%, the advantageous properties of corn silk will be beneficial to the organoleptic qualities of a nontobacco smokeless composition. It is preferable that the amount of corn silk in the herbal component will be in the range of about 50% to 100% by weight of the herbal component. More preferably, corn silk is the only ingredient in the herbal component. When the herbal component consists essentially of corn silk, the corn silk may be present in any amount that is more than about 50% by weight of the herbal component without materially affecting the basic and novel characteristics of the resulting nontobacco moist snuff composition.

The corn silk to be included in the herbal component has a particle size of about 4 to about 40 mesh as measured using NBS screen sizes. Preferably, the corn silk to be included in the herbal component has a particle size of about 4 mesh to about 20 mesh as measured using NBS screen sizes. This invention contemplates that any particle size may be used, but particles less than about 40 mesh may be too small to form a coherent mass in the mouth, while uncut corn silk and/or corn silk larger than about 4 mesh may be too large to be easily packable in the mouth.

Preferably, the corn silk to be included in the herbal component is dried before being combined with the casing component. Further details are provided herein below regarding methods for making nontobacco moist snuff compositions according to the present invention. When dried, the corn silk has a moisture content that is less than about 10%, and preferably about 7%. The dried corn silk will absorb more of the casing component, which enhances the organoleptic qualities of the resulting nontobacco moist snuff composition.

Corn silk in the herbal component has numerous advantageous physical properties compared to previously known herbs. For example, corn silk is uniform in size, and does not contain stalks or seeds. Corn silk is also light, soft, elastic, and absorbent. In addition, corn silk has virtually no smell or taste. The advantageous physical properties of corn silk are utilized in combination with a casing component to more clearly realize a nontobacco moist snuff composition that is (1) uniform in color and size, (2) light, soft, airy, elastic, not sticky, and not soggy, (3) smooth and packable in the mouth, (4) without a inappropriate vegetal smell or flavor, and (5) capable of maintaining or holding smells and flavors that are desirable to the user for a period of time that is satisfying to the user. In other words, the advantageous physical properties of corn silk are utilized in combination with a casing component to provide a superior nontobacco moist snuff composition with organoleptic qualities that are favorably comparable to similarly prepared tobacco-based moist snuff compositions. When the percent of corn silk by weight of the herbal component is increased, the organoleptic qualities of the nontobacco moist snuff composition are increased.

When the herbal component consists essentially of corn silk, the herbal component may comprise additional non-essential ingredients to enhance certain organoleptic qualities and/or provide certain physiological effects. The additional non-essential ingredients may be classified as antiseptics, demulcents, diuretics, emollients, stimulants, tonics, rubefacients, sialagogues, hemostatics, vulneraries, or combinations thereof. For example, the non-essential ingredients of the herbal component may comprise: red clover, Echinacea, ginger, rose hips, white clover, sweet clover, licorice, ginseng, guaraná, anise, clove, as well as any other suitable leaf, root, or gum (e.g., gum tragacanth, gum arabic, gum acacia, and/or gum karaya), and any combination thereof. Since every herb contains biochemical constituents that can have an effect on the body, the potential additional non-essential ingredients for the herbal component are limited only by the desired overall organoleptic qualities and physiological effects of the nontobacco moist snuff composition.

The following Table 5 summarizes the approximate ranges for ingredients of the herbal component in percent by weight of the herbal component.

TABLE 5

| Herbal Component Ingredients - Approximate Range in % by Weight of the Herbal Component | | |
|---|---|---|
| INGREDIENTS | APPROX. LOWEST | APPROX. HIGHEST |
| Corn silk | 50.00 | 100.00 |
| Non-essential Ingredients | 0.00 | 50.00 |

2. The Casing Component

The casing component is combined with the herbal component to create nontobacco moist snuff compositions according to the present invention. The casing material is used in varying amounts as a means of binding the mixture together; providing the desired amount of moisture; imparting certain beneficial digestive qualities; and in imparting the particular desired flavor of the product. The casing component may comprise ingredients that are liquid, semi-liquid, or solid. The solid ingredients may be dissolved or dispersed in the liquid and/or semi-liquid ingredients.

Molasses is an essential ingredient in the casing component. Molasses is a binder, helps prevent drying out of the herbal component, and imparts flavor to the resulting nontobacco moist snuff composition. Molasses is present as a liquid in the casing component in an amount ranging from about 15% to about 40% by weight of the total composition, or from about 21% to about 45.25% by weight of the casing component.

Glycerin and propylene glycol, are useful primarily as humectants, and may impart a slight sweetness to the casing component. The liquid mixture of glycerin and propylene glycol may be present in the casing component as a pre-mixed solution in an amount ranging from about 9% to 21% by weight of the total composition, or about 10.50% to about 25% by weight of the casing component. Propylene glycol is also useful as a carrier for preservatives, which as may present in the casing component, as discussed below.

Water is used in varied amounts to aid in blending the composition, and imparting moistness and softness to the dry ingredients. It also serves as a thinner for the moist ingredients in the casing. Water is present in the casing component is an amount ranging from about 8.0% to about 18.0% by weight of the total composition, or about 9.5% to about 21.50% by weight of the casing component.

Various flavoring compositions may be included in the casing component in a range of about 2.0% to about 10.0% by weight of the total composition, or about 2.0% to about 12% by weight of the casing component. The flavoring compositions impart strong and/or aromatic aroma and taste to nontobacco moist snuff compositions. Examples of flavoring compositions useful for nontobacco moist snuff compositions according to the present invention include, but are not limited to, any flavoring composition that smells and/or tastes like mint, clove, cherry, or cinnamon. Flavoring compositions with a "classic" flavor and/or taste resemble the smell and/or taste of Copenhagen® tobacco-based moist snuff, produced by U.S. Smokeless Tobacco Co., Greenwich, Conn. For the present invention, the flavoring compositions are preferably liquids.

Caramel color may be included in the casing component to impart a desirable dark brown color to the composition, as well as an amount of flavor. Caramel color may be present in the casing component as a liquid in an amount ranging from about 3.5% to about 8.1% by weight of the total composition, or about 4.0% to about 8.25% by weight of the casing component.

Sodium chloride (salt) functions as a preservative and for inducing salivation. Preferably, when present, the salt is very finely ground and completely dispersed in the casing component. Salt may be present in the casing component as a dissolved solid in an amount ranging from about 3.0% to about 5.0% by weight of the total composition, or about 3.5% to about 6.0% by weight of the casing component.

Sodium Bicarbonate is added to the composition to act as a buffer to neutralize acidity in the casing component that may be produced by other ingredients thereof. Sodium bicarbonate may be present as a dissolved solid in an amount ranging from about 1% to about 3% by weight of the total composition, or from about 1% to about 3.75% by weight of the casing component.

Ginseng (*Panax ginseng* or *Panax quinquefolium*) is a much renowned root that may be incorporated in its dried powdered form into the casing component to add aroma and a bitter, licorice-like flavor. Ginseng may also have medicinal properties, such as stimulating the immune system, enhancing digestion, and relieving fatigue. Ginseng may be present as a dispersed solid in an amount ranging from about 1% to about 2% by weight of the total composition, or from about 1% to about 2.5% by weight of the casing component.

Guaraná (*Paullinia cupana*) in powdered form is ground from the seeds of the plant. Each guarana seed comprises caffeine in an amount about 5% by weight of the total seed (25,000 to 75,000 ppm). Guarana powder is well known for its stimulant and thermogenic actions. Guaraná or any form of caffeine may be present as a liquid and/or a dispersed solid in an amount ranging from about 0.2% to about 1% by weight of the total composition, or from about 0.2% to about 1.25% by weight of the casing component.

Saccharin or other concentrated natural and artificial sweeteners, such as aspartame and MAG, may be included in the casing component to impart a desired sweetness. Sweeteners may be present as a liquid, semi-liquid, dissolved solid, and/or dispersed solid in an amount ranging from about 0.15% to about 0.35% by weight of the total composition, or from about 0.15% to about 0.5% by weight of the casing component.

Powdered "cayenne" pepper (*Capsicum* spp.) may be added to the casing component to produce a spicy taste or "bite" in the mouth. Amongst the numerous species of *Capsicum* suitable for use in the present invention, preferable *Capsicum* species include *Capsicum annuum, Capsicum baccatum, Capsicum chinense, Capsicum frutescens*, and *Capsicum pubescens*. Cayenne pepper contains up to 1.5% capsaicinoids (pungent principles) including 0.1-1% capsaicin, 6,7-dihydrocapsaicin, nprdihydrocapsaicin, homodihydrocapsaicin, and homocapsaicin; fixed oils; carotenoid pigments including capsanthin, capsorubin, alpha- and beta-carotene; steroid glycosides, including capsicosides A, B, C, and D; 9-17% fats; 12-15% proteins; vitamins A and C; and trace volatile oils. Capsaicin is the primary chemical agent that produces the characteristic bite of cayenne pepper in the mouth.

It is important to provide an appropriate bite which is usable in the composition. However, cayenne peppers contain various levels of capsaicin depending on the variety, area of cultivation, etc. This can present a problem since excessive capsaicin will result in a very intense, and possibly painful, burning sensation in the mouth. A key to the inclusion of cayenne pepper in a nontobacco moist snuff composition is that it should be substantially evenly dispersed therein. Accordingly, it is necessary to provide an amount of cayenne pepper low enough so that a sufficient amount of capsaicin can be included, while taking care to prevent exposure to an unnecessarily high burning sensation. The heat levels of cayenne peppers range from about 3,500 Scoville Heat Units (SHUs) to about 350,000 SHUs. A preferred range for the present invention being from about 20,000 SHUs to about 60,000 SHUs. A more preferred amount is about 40,000 SHU's.

A preferred grind for cayenne pepper powder for use in the present invention is from about #30 Duraloy (equivalent to U.S. #20) to about #58 Duraloy (equivalent to #48 U.S.). A more preferred grind is about #54 Duraloy (equivalent to U.S. #45). A fine powder grind has been found to be useful in providing the desired initial and sustained bite which is necessary in a nontobacco moist snuff composition according to the present invention.

Cayenne pepper may be present in the casing component as a dispersed solid in an amount ranging from about 0.01% to about 0.30% by weight of the total composition, or from about 0.01% to about 0.50% by weight of the casing component.

As stated above in the Description of the Prior Art, it is likely that the primary users of nontobacco moist snuff compositions according to the present invention will be current users of tobacco-based moist snuff compositions. As such, it is likely that many users of nontobacco moist snuff compositions according to the present invention will have an addiction to nicotine. Some other users of nontobacco moist snuff compositions according to the present invention will not have an addiction to nicotine, and will simply enjoy the physiological effects of nicotine. Therefore, nicotine may be included in the casing component to provide a nontobacco moist snuff composition with a desirable amount of nicotine without appreciable ill effects. When present, it is preferable that nicotine be included as a liquid in the casing component in an amount ranging from about 0.01% to about 0.10% by weight of the total composition, or from about 0.01% to about 0.15% by weight of the casing component.

Certain preservatives known in the art as effective and safe for use in products held in the mouth may be included in the composition. Preferred preservatives for use in the present invention include, but are not limited to, parabens, such as methylparaben and propylparaben. When present, preservatives will be included in the casing component in an amount ranging from about 0.2% to about 0.7% by weight of the total composition.

Other ingredients may be incorporated into the casing component to enhance the organoleptic qualities and/or physiological effects of the nontobacco moist snuff composition.

The following Table 6 summarizes the approximate ranges for preferred ingredients of the casing component in percent by weight of the casing component.

TABLE 6

Casing Component Ingredients - Approximate Range in % by Weight of the Casing Component

| INGREDIENT | APPROX. LOWEST | APPROX. HIGHEST |
|---|---|---|
| Molasses | 21.00 | 45.25 |
| Glycerin/propylene glycol/preservatives | 10.50 | 25.00 |
| Water | 9.50 | 21.50 |
| Flavoring - Peppermint* | 5.50 | 12.00 |
| Flavoring - Wild cherry* | 5.50 | 12.00 |
| Caramel color | 4.00 | 8.25 |
| Sodium chloride | 3.50 | 6.00 |
| Flavoring - Wintergreen* | 3.50 | 7.25 |
| Flavoring - Classic* | 2.00 | 6.00 |
| Flavoring - Cinnamon* | 2.00 | 6.00 |
| Ginseng | 1.00 | 2.50 |
| Sodium bicarbonate | 1.00 | 3.75 |
| Guarana | 0.20 | 1.25 |
| Artificial sweetener | 0.15 | 0.50 |
| Cayenne powder | 0.01 | 0.60 |
| Nicotine** | 0.01 | 0.25 |

*Preferably, only one flavoring ingredient is used per composition
**Optional ingredient 3. Exemplary Nontobacco Moist Snuff Compositions a. Nontobacco Moist Snuff Composition with Classic Flavor

TABLE 7

Classic Flavor - Ingredients in Approx. % by Weight of the Total Composition

| INGREDIENT | APPROX. % |
|---|---|
| Cayenne powder | 0.50 |
| Ginseng | 1.00 |
| Guarana | 0.50 |
| Corn silk | 25.00 |
| Sodium bicarbonate | 2.50 |
| Sodium chloride | 4.50 |
| Flavoring - Classic | 3.00 |
| Molasses | 28.00 |
| Caramel color | 6.00 |
| Glycerin/propylene glycol/preservatives | 15.00 |
| Water | 14.00 |

b. Nontobacco Moist Snuff Composition with Wintergreen Flavor

TABLE 8

Wintergreen Flavor - Ingredients in Approx. % by Weight of the Total Composition

| INGREDIENT | APPROX. % |
|---|---|
| Cayenne powder | 0.10 |
| Ginseng | 1.00 |
| Guarana | 0.40 |
| Corn silk | 25.00 |
| Sodium bicarbonate | 1.00 |
| Sodium chloride | 5.00 |
| Flavoring - Wintergreen | 5.00 |
| Molasses | 30.00 |
| Caramel color | 5.50 |
| Glycerin/propylene glycol/preservatives | 15.00 |
| Water | 12.00 |

c. Nontobacco Moist Snuff Composition with Mint Flavor

TABLE 9

| Mint Flavor - Ingredients in Approx. % by Weight of the Total Composition | |
|---|---|
| INGREDIENT | APPROX. % |
| Cayenne powder | 0.10 |
| Ginseng | 1.00 |
| Guarana | 0.40 |
| Corn silk | 24.00 |
| Sodium bicarbonate | 1.00 |
| Sodium chloride | 5.00 |
| Flavoring - Peppermint | 8.00 |
| Molasses | 30.00 |
| Caramel color | 5.50 |
| Glycerin/propylene glycol/preservatives | 15.00 |
| Water | 10.00 |

d. Nontobacco Moist Snuff Composition with Cherry Flavor

TABLE 10

| Cherry Flavor - Ingredients in Approx. % by Weight of the Total Composition | |
|---|---|
| INGREDIENT | APPROX. % |
| Cayenne powder | 0.10 |
| Ginseng | 1.00 |
| Guarana | 0.40 |
| Corn silk | 24.30 |
| Sodium bicarbonate | 1.00 |
| Sodium chloride | 5.00 |
| Flavoring - Wild cherry | 6.00 |
| Molasses | 28.00 |
| Caramel color | 6.00 |
| Glycerin/propylene glycol/preservatives | 16.00 |
| Water | 12.00 |
| Artificial sweetener | 0.20 |

e. Nontobacco Moist Snuff Composition with Cinnamon Flavor

TABLE 11

| Cinnamon Flavor - Ingredients in % by Weight of the Total Composition | |
|---|---|
| INGREDIENT | APPROX. % |
| Cayenne powder | 0.20 |
| Ginseng | 1.00 |
| Guarana | 0.50 |
| Corn silk | 24.50 |
| Sodium bicarbonate | 2.50 |
| Sodium chloride | 5.00 |
| Flavoring - Cinnamon | 3.50 |
| Molasses | 29.00 |
| Caramel color | 6.00 |
| Glycerin/propylene glycol/preservatives | 15.00 |
| Water | 12.80 |

f. Nontobacco Moist Snuff Composition with Nicotine

TABLE 12

| Classic and Nicotine Flavors - Ingredients in % by Weight of the Total Composition | |
|---|---|
| INGREDIENT | APPROX. % |
| Cayenne powder | 0.30 |
| Corn silk | 25.00 |
| Sodium bicarbonate | 2.50 |
| Sodium chloride | 4.50 |
| Flavoring - Classic | 3.00 |
| Molasses | 29.00 |
| Caramel color | 5.50 |
| Glycerin/propylene glycol/preservatives | 15.00 |
| Water | 15.00 |
| Nicotine | 0.20 |

4. Exemplary Method for Making Nontobacco Moist Snuff Compositions

After being removed from the corn husks, the corn silk washed, sanitized, cut, and dried. These steps may be performed in any order. Preferably, the corn silk is first dried, then washed, sanitized, and cut. It is not necessary to either smoke or age the corn silk. When dried, the moisture content of the corn silk is reduced to about 10% or, preferably, about 7%. The corn silk is preferably air dried at ambient temperature. The dried corn silk will absorb more of the casing component, which enhances the organoleptic qualities of the resulting nontobacco moist snuff composition. When cut, the particle size of the corn silk is about 4 mesh to about 40 mesh or, preferably, about 4 mesh to about 20 mesh as measured using NBS screen sizes. This invention contemplates that any particle size may be used, but particles less than about 40 mesh may be too small to form a coherent mass in the mouth, while uncut corn silk and/or corn silk larger than about 4 mesh may be too large to be easily packable in the mouth.

All the liquid or semi-liquid ingredients are mixed together for about 20 to about 40 minutes to produce the liquid portion of the casing component. Prior art procedures for producing non-tobacco moist snuff have required a more complex set of steps to suitably mix the liquid ingredients together. Primarily due to the excellent properties of the corn silk in the herbal component, procedures according to the present invention may mix all the liquid ingredients together in one step, which is much more efficient and uncomplicated. Preferably, the liquid ingredients are: caramel color, the flavoring composition, glycerin/propylene glycol/preservatives, molasses, water, and optionally nicotine. To aid in thoroughly mixing the liquid portion, one or more of the liquids may be warmed to a temperature between about 100° F. to about 120° F. prior to mixing.

The dry ingredients of the casing component are mixed with the herbal component. The dry ingredients or portion of the casing component preferably comprises artificial sweetener, cayenne powder, ginseng, guarana, sodium bicarbonate, and sodium chloride. The dry portion of the casing component is preferably mixed with the herbal component for at least about 2 minutes in a blender, i.e., a ribbon-type blender.

After the dry ingredients of the casing component are well mixed with the herbal component, the liquid portion of the casing component is dispensed into the ribbon blender. The liquid portion of the casing component is fully dispensed into the ribbon blender in about 5 minutes. Once the liquid portion of the casing component is fully dispensed, the resulting composition is blended for approximately five minutes.

The resulting moist snuff composition is sealed for a storage/tempering/curing time of about 6 hours to about 12 hours before beginning the packing process. During this time, the casing component more fully blends with the herbal component resulting in a proper consistency for packaging. The finalized non-tobacco moist snuff composition may be packaged in any suitable container, such as in a tin, in a plurality of individual mesh pouches, or any other package known in the art.

Advantageously, primarily due to the superior qualities of the corn silk in the herbal component, nontobacco moist snuff compositions according to the present invention do not need extended tempering, bulking, or other processing steps necessary in prior art methods. Preferably, during processing, nontobacco moist snuff compositions according to the present invention are kept in carefully controlled humidity and in cool temperatures. The finalized, packaged nontobacco moist snuff composition is a uniform, fine-textured product that closely imitates tobacco-based moist snuff compositions.

Referring to FIG. 2, there is shown a kettle 2 useful for mixing the liquid ingredients of the casing component. The kettle has a total capacity of about 60 gallons and a useful capacity of about 50 gallons. The kettle includes a high speed agitator 3 to blend the ingredients of the casing component. The liquid portion of the casing component produced in kettle 2 is sent via a pump 4 from kettle 2 to one or more spray bars in the blender (not shown), which is described below. A preferred kettle is manufactured by Ross Mixing, Inc. on a special order basis.

Figure 3:
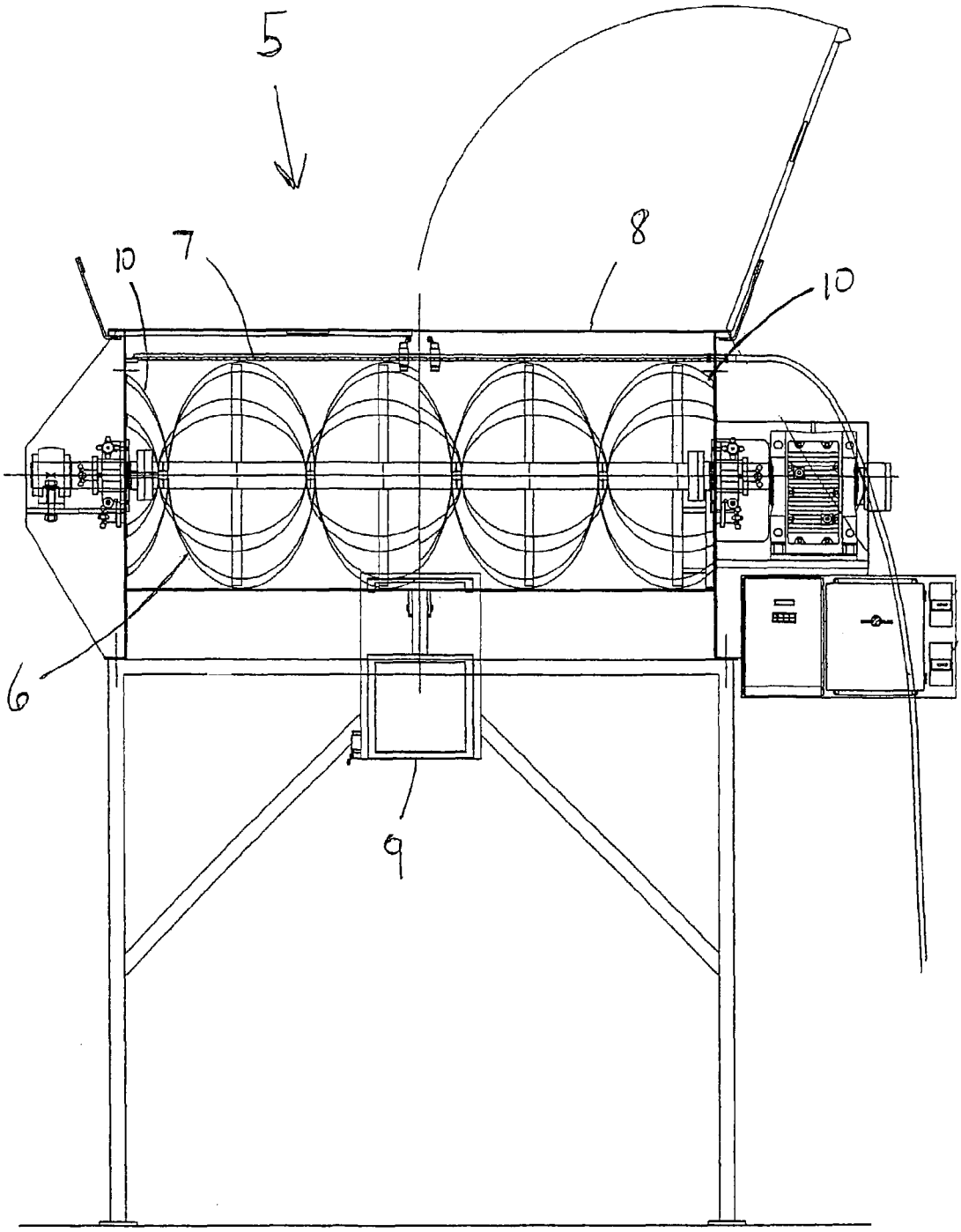
FIG. 3 is a sectional view of a horizontal mixer useful for making a nontobacco moist snuff composition according to the present invention showing the ribbon blades and drop door thereof.

Referring to FIG. 3, there is shown a horizontal ribbon blender 5 useful for blending the ingredients, portions, and components of moist snuff compositions according to the present invention. Ribbon blender 5 comprises ribbon agitators 6 and a spray bar 7. Significantly, ribbon blender 5 has end scrappers 10 on agitators 6 to prevent ingredients from being caught in the corners of ribbon blender 5 during blending. The herbal component and dry ingredients of the casing component are poured into horizontal ribbon blender 5 via a hinged top 8. The liquid portion of the casing component is sprayed through spray bar 7 under air pressure onto the herbal component there below. Spray bar 7 has holes that are approximately ⅛" in diameter and 1" apart from one another. Ribbon agitators 6 thoroughly blend the herbal component and the casing component. The resulting nontobacco moist snuff composition is dispensed through a drop door 9. A preferred horizontal ribbon blender is manufactured by Ross Mixing, Inc. and sold as Model 42N.

While this invention has been described in detail with particular reference to preferred embodiments thereof, it will be understood that variations and modifications may be effected that are within the spirit and scope of this invention, as described hereinabove and recited in the following claims.

We claim:

1. A non-tobacco moist snuff composition comprising:

an herbal component having corn silk as the primary ingredient, the corn silk being present in the range of about 50% to about 100% by weight of the herbal component, the corn silk being dried to a moisture content of less than about 10% such that strands of the corn silk are substantially vacated of moisture; and a casing component infused into the strands of the corn silk such that a portion of the casing component is located within the strands, the casing component comprising:

a flavoring composition present in an amount about 2.0% to about 10.0% by weight of the total composition, a paraben preservative present in an amount about 0.2% to about 0.7% by weight of the total composition, and an expectorant, a liquid nicotine component present in an amount ranging from about 0.01% to about 0.10% weight of the total composition, wherein the corn silk has a uniform color and particle size between about 4 mesh to about 40 mesh according to NBS screen sizes, and wherein the corn silk moisture content and particle size produce a moist snuff composition having organoleptic qualities comparable to the organoleptic qualities of tobacco-based moist snuff compositions.

2. The non-tobacco moist snuff composition of claim 1, wherein the corn silk has a particle size between about 4 mesh and about 20 mesh according to NBS screen sizes.

3. The non-tobacco moist snuff composition of claim 1, further comprising an additional ingredient selected from the group consisting of: red clover, Echinacea, ginger, rose hips, white clover, sweet clover, licorice, ginseng, guarana, anise, clove, gum tragacanth, gum arabic, gum acacia, gum karaya, and combinations thereof.

4. The non-tobacco moist snuff composition of claim 1, wherein the herbal component is present in an amount about 10% and about 50% by weight of the composition.

5. The non-tobacco moist snuff composition of claim 1, wherein the corn silk is present in an amount about 16% and about 32% by weight of the composition.

6. The non-tobacco moist snuff composition of claim 1, further comprising caffeine.

7. A method of producing a non-tobacco moist snuff composition comprising the steps of:

drying corn silk to a moisture content between about 7% and about 10% such that strands of the corn silk are substantially vacated of moisture;

providing an herbal component having the corn silk as the primary ingredient;

providing a casing component comprising: a flavoring composition present in an amount about 2.0% to about 10.0% by weight of the total composition, a paraben preservative present in an amount about 0.2% to about 0.7% by weight of the total composition, a liquid nicotine component present in an amount ranging from about 0.01% to about 0.10% weight of the total composition, and an expectorant;

infusing the casing component into strands of the corn silk;

locating a portion of the casing component in the strands of corn silk;

wherein the corn silk is present in a range of about 50% to about 100% by weight of the herbal component;

wherein the corn silk has a uniform color and particle size between about 4 mesh to about 40 mesh according to NBS screen sizes; and wherein the corn silk moisture content and particle size produce a moist snuff composition having organoleptic qualities comparable to the organoleptic qualities of non-tobacco moist snuff compositions.

8. The method of producing a non-tobacco moist snuff composition according to claim 7, further comprising a step of cutting the corn silk to a particle size between about 4 mesh and about 20 mesh according to NBS screen sizes.

9. The method of producing a non-tobacco moist snuff composition according to claim 7, further comprising a step of washing and sanitizing the corn silk.

10. The method of producing a non-tobacco moist snuff composition according to claim 7, wherein the casing component comprises caffeine.

11. The moist snuff composition of claim 1, wherein the herbal component is substantially free of leaves.

* * * * *